US007387225B2

(12) United States Patent
Fox

(10) Patent No.: US 7,387,225 B2
(45) Date of Patent: Jun. 17, 2008

(54) GARMENT ATTACHABLE ELASTOMERIC LANYARD

(76) Inventor: Michael Fox, 1496 Eastmont Ave., East Wenatchee, WA (US) 98802

( * ) Notice: Subject to any disclaimer, the term of this patent is extended or adjusted under 35 U.S.C. 154(b) by 73 days.

(21) Appl. No.: 11/384,941

(22) Filed: Mar. 20, 2006

(65) Prior Publication Data

US 2007/0214610 A1 Sep. 20, 2007

(51) Int. Cl.
*A45F 3/14* (2006.01)

(52) U.S. Cl. ..... 224/257; 224/258; 224/259; 224/908; 224/909

(58) Field of Classification Search ..... None
See application file for complete search history.

(56) References Cited

U.S. PATENT DOCUMENTS

| | | | | |
|---|---|---|---|---|
| 939,871 | A | 11/1909 | Sherman | |
| 1,845,099 | A | 2/1932 | Popelakova | |
| 2,643,803 | A | 6/1953 | Bates | |
| 2,970,316 | A | 2/1961 | Silin | |
| 4,125,211 | A | 11/1978 | Handsman | |
| 4,272,852 | A | 6/1981 | Bell | |
| 4,273,216 | A | 6/1981 | Weissmann | |
| 5,016,797 | A * | 5/1991 | Rowledge | 224/257 |
| 5,440,761 | A | 8/1995 | Abrams et al. | |
| 6,892,395 | B2 | 5/2005 | Schweer | |

FOREIGN PATENT DOCUMENTS

| | | |
|---|---|---|
| CA | 2.306.544 | 10/2000 |
| WO | WO2004098483 | 11/2004 |

OTHER PUBLICATIONS https://www.crookedhorn.com.

* cited by examiner

*Primary Examiner*—Jack W. Lavinder
(74) *Attorney, Agent, or Firm*—Michael I Kroll

(57) ABSTRACT

A garment mounted harness having an associated vest and/or back pack having attachment means for engagement of said garment mounted harness to an associated vest or backpack having a plurality of mating attachment ends for attachment of the straps thereto garment thereto of the straps and connecting elements of the present invention enabling the user to carry an optical device hands free about the front of ones chest for easy quick use and access when required. Additionally the present invention has adjustments about the strap portion for length and comfort adjustment.

6 Claims, 16 Drawing Sheets

GARMENT ATTACHABLE ELASTOMERIC LANYARD

BACKGROUND OF THE INVENTION

1. Field of the Invention

The present invention relates generally to harnesses and, more specifically, to adjustable lengths of elastomeric material fastened to a garment extending from the upper shoulder to their respective side having slidable fasteners for attachment thereto of optical equipment.

The present invention provides means whereby the straps are fixed to the aforementioned attachment points or one member of a mating pair of releasable fasteners are permanently fixed to their respective attachment points with the elastomeric straps having the other members of the mating fasteners fixed to the distal ends whereby the straps are releasable at one or both ends.

Additionally, the present invention provides that the elastomeric straps can be fixed to a backpack conjointly with the backpack straps providing means for attachment of optical equipment 2. Description of the Prior Art There are other harness devices designed for equipment. Typical of these is U.S. Pat. No. 939,871 issued to Sherman on Nov. 9, 1909.

Another patent was issued to Popelakova on Feb. 16, 1932 as U.S. Pat. No. 1,845,099. Yet another U.S. Pat. No. 2,643,803 was issued to Bates on Jun. 30, 1953 and still yet another was issued on Feb. 7, 1961 to Silin as U.S. Pat. No. 2,970,316.

Another patent was issued to Handsman on Nov. 14, 1978 as U.S. Pat. No. 4,125,211. Yet another U.S. Pat. No. 4,272,852 was issued to Bell on Jun. 16, 1981. Another was issued to Weissmann on Jun. 16, 1981 as U.S. Pat. No. 4,273,216 and still yet another was issued on Aug. 15, 1995 to Abrams, et al. as U.S. Pat. No. 5,440,761.

Another patent was issued to Schweer on May 17, 2005 as U.S. Pat. No. 6,892,395. Yet another International Patent Application No. WO2004098483 was issued to Rogers on 18 Nov. 2004. Another was issued to Townsend on Oct. 21, 2000 as Canadian Patent No. CA2306544.

U.S. Pat. No. 939,971

Inventor: Perry B. Sherman

Issued: Nov. 9, 1909

The combination with an outer garment of the character described, of an elongated pocket apart from said garment but adapted to lie within the skirt thereof and extending substantially entirely around such skirt, and means firmly secured between the coat lining and material of the coat proper for detachably securing said pocket to said garment at points along said pocket intermediate thereof, said lining being provided with slits for such means to extend through when desired, whereby said means may be hidden between the coat lining and material of the coat after the removal of the pocket.

U.S. Pat. No. 1,845,009

Inventor: Marie Popelakova

Issued: Feb. 16, 1932

An aviation garment comprising a coat, a parachute girth having a pair of looped portions, the ends of said girth depending therefrom, means securing said girth to said coat with said looped portions respectively encircling the armholes of said coat and a circular leg girth secured to each end of said first girth.

U.S. Pat. No. 2,643,803

Inventor: Jack R. Bates

Issued: Jun. 30, 1953

A device of the character described to be worn by a person and comprising a belt adapted to encircle a person at a point adjacent the armpits, a pair of shoulder straps slidably and adjustably mounted on each of said shoulder straps, a resilient member mounted in each of said retainers and substantially covered thereby and having one end thereof secured to its retainer, the free end of each of said resilient members having a clasp for attaching an article suspended between the free ends of said resilient members.

U.S. Pat. No. 2,970,316

Inventor: Jacob Silin

Issued: Feb. 7, 1961

A combined article of clothing and accessory comprising a jacket, a pouch school bag having a rear wall bearing against the back of the jacket, a front wall spaced from and connected to said rear wall and an upper end, a flap having one edge hingedly secured to said rear wall adjacent said open upper end and arranged to overlap said front wall to close said open upper end means removable securing said overlapping flap portion to said front wall, a pair of straps, each of said straps having one end secured to said flap in laterally spaced relation to each other and extending over the shoulders to the front of said jacket, epaulets secured across the shoulders of said jacket adjacent the corresponding jacket sleeve in positions to laterally engage said strap, thereby restraining them from slipping off the shoulders, means irremovably securing the straps to the front and on the outside of the jacket, and pouches on the front of the jacket receiving the free ends of said straps.

U.S. Pat. No. 4,125,221

Inventor: Frederic B. Handsman

Issued: Nov. 14, 1978

This strap goes over the shoulders of the person wearing it and supports one or more cameras hanging down in front of the body of the wearer. Portions of the strap that extend downward behind the shoulders converge toward one another and are connected with a stretchable or elastic part of the strap which has its lower end anchored to a trouser band or belt, and which prevents the converging parts of the strap from moving upward into contact with the back of the neck of the person wearing the strap. Thus the weight of the cameras never bears against the neck. The stretchable part of the back portion of the strap yields when the wearer bends forward, and this prevents uncomfortable tightening of the strap.

U.S. Pat. No. 4,272,852

Inventor: Richard S. Bell

Issued: Jun. 16, 1981

An outer garment having means affixed to the shoulders for removably securing a knapsack at either the front, the rear, or knapsacks at both the front and rear of the garment is disclosed. A pair of shoulder straps, each extending over one of the shoulders of the garment from the front to the rear, has free ends adapted to secure and remove the knapsack or knapsacks, the securing means comprising a loop connecting the strap to a ring. The knapsack is equipped with a pair of hook-type snap fasteners, such as a snap hook, arranged on the knapsack to permit attaching to the rings at the ends of the shoulder straps on the front of the garment, or the rings at the end of the shoulder straps at the rear of the garment. Alternatively, two knapsacks so equipped can be so attached, one at the front and one at the rear.

U.S. Pat. No. 4,273,216

Inventor: Rita H. Weissmann

Issued: Jun. 16, 1981

A safety jacket adapted to have a line secured thereto for anchoring the wearer of the jacket in the event he loses his footing. The jacket comprises a harness having a pair of shoulder straps and a belt made of polypropylene which is threaded through loops at the ends of the shoulder straps. Each of the shoulder straps is permanently affixed to the jacket by being stitched to the jacket material and to another piece of webbing on the opposite side of the jacket material at several points of attachment. The belt is similarly secured to the jacket at least one point of attachment. When the jacket is worn, there is no possible relative movement of the harness with respect to the jacket and of the jacket with respect to the wearer, thus permanently maintaining the harness in the desired position.

U.S. Pat. No. 5,440,761

Inventor: Jack Abrams, et al

Issued: Aug. 15, 1995

A multi-faceted photographer's vest (10) includes a half of a typical camera strap (12) extending from the right shoulder area, and a half of a typical camera strap (14) extending from the left shoulder area. Each camera strap half (12),(14) has a material end (16),(18) that is sewn or stitched to the vest (10) in the right and left shoulder areas, respectively, so that they are permanently and securely attached thereto. Each camera strap half (12),(14) also has a free end (20),(22) that lays approximately mid-torso, on the right and left sides, respectively, of a vest wearer (24). The free end (20),(22) of each camera strap half (12),(14) is attached to a camera (42) in a typical manner. The vest (10) also provides several pockets and compartments (44),(62) for storing photography related accessories and other items.

U.S. Pat. No. 6,892,395

Inventor: James R. Schweer

Issued: May 17, 2005

The safety garment for industrial and construction workers, and hunters incorporates a safety harness in to the body of a jacket, coat, or other apparel. The garment has a safety harness with a central attachment ring receiving a safety line, anchoring a wearer to a beam or tree trunk. The safety harness may be sewn on the outer or inner surface of a removable, reversible inner liner or a vest, or can be attached to an outer shell such as an outer vest, jacket, shirt, parka, or other garment covering the harness. The vest may be blaze orange on one side and camouflage patterned on the other. During a fall, pulling forces on the harness are equalized in both directions, providing maximal distribution of force on the wearer. The waist belt or other portion of the safety harness has attachments for removable leg loop/crotch straps and other removable accessories.

International Patent Application Number WO2004098483

Inventor: Dean Rogers

Published: 18 Nov. 2004

A fully mobile, individually worn, chest-mounted camera (also other objects) support apparatus incorporating a telescopically column raised tripod head, FIG. 1 (12) mounted to an articulated dual plate structure secured to the body with a shoulder harness, FIG. 2 (18, 21, 22). The apparatus features (see FIG. 1, 2, 3) a tripod upper assembly mounted to a moveable outer plate like structure (2). The outer plate (2) is connected to an ergonomically body fitting chest plate (1) with a pair of dual-pivoting hinges (7) attached near the lower edges of both plates, and with a pair of telescopic lockable arms (8) mounted to L brackets (9) at the tops of the two plates (1, 2); thereby allowing for angular adjustments of the outer plate (2) relative to the chest plate (1). The outer plate (2) can also be slide upward via the two dual-pivoting hinges, (7) which attach to and slide on guide tracts, and the outer plate (2) can be locked in place in an upward position with the use of a lock-knob fixed to a separate center tract.

Canadian Patent Number CA2306544

Inventor: Jonathan Townsend

Issued: 25 Apr. 2000

A combination garment and safety harness (10, 80, 280) for fall arresting and rescue from confined spaces. The safety harness (66, 84, 126) is attached to the interior of an article of clothing such as a jacket (16), vest (104), overalls (82), or coveralls (108). Donning the article of clothing automatically positions the harness for use. The safety harness may have a breakaway attachment strap (200) for providing protection from blunt head trauma injury to the wearer during fall arrest and rescue. The safety harness may be used by persons working at dangerous heights or in confined spaces.

While these harnesses may be suitable for the purposes for which they were designed, they would not be as suitable for the purposes of the present invention, as hereinafter described.

SUMMARY OF THE PRESENT INVENTION

A primary object of the present invention is to provide a garment mounted harness having a plurality of straps for holding an optical device about ones chest ready and available for use Another object of the present invention is to provide garment mounted harness having a plurality of attachments providing means for securing the present invention to a garment typically a vest or backpack situated for such.

Yet another object of the present invention is to provide garment mounted harness having an adjustable length.

Still yet another object of the present invention is to provide garment mounted harness having a quick release means of attachment for quick disengagement from ones body.

Another object of the present invention is to provide garment mounted harness having an associated vest having a plurality of mating attachment ends for attachment of the straps thereto.

Yet another object of the present invention is to provide garment mounted harness having an associated backpack and straps having a plurality of mating attachment ends for attachment of the straps thereto.

Additional objects of the present invention will appear as the description proceeds.

The present invention overcomes the shortcomings of the prior art by providing garment mounted harness having an associated vest and/or back pack having attachment means for engagement of said garment mounted harness to an associated vest or backpack having a plurality of mating attachment ends for attachment of the straps thereto garment thereto of the straps and connecting elements of the present invention enabling the user to carry an optical device hands free about the front of ones chest for easy quick use and access when required. Additionally the present invention has adjustments about the strap portion for length and comfort adjustment.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
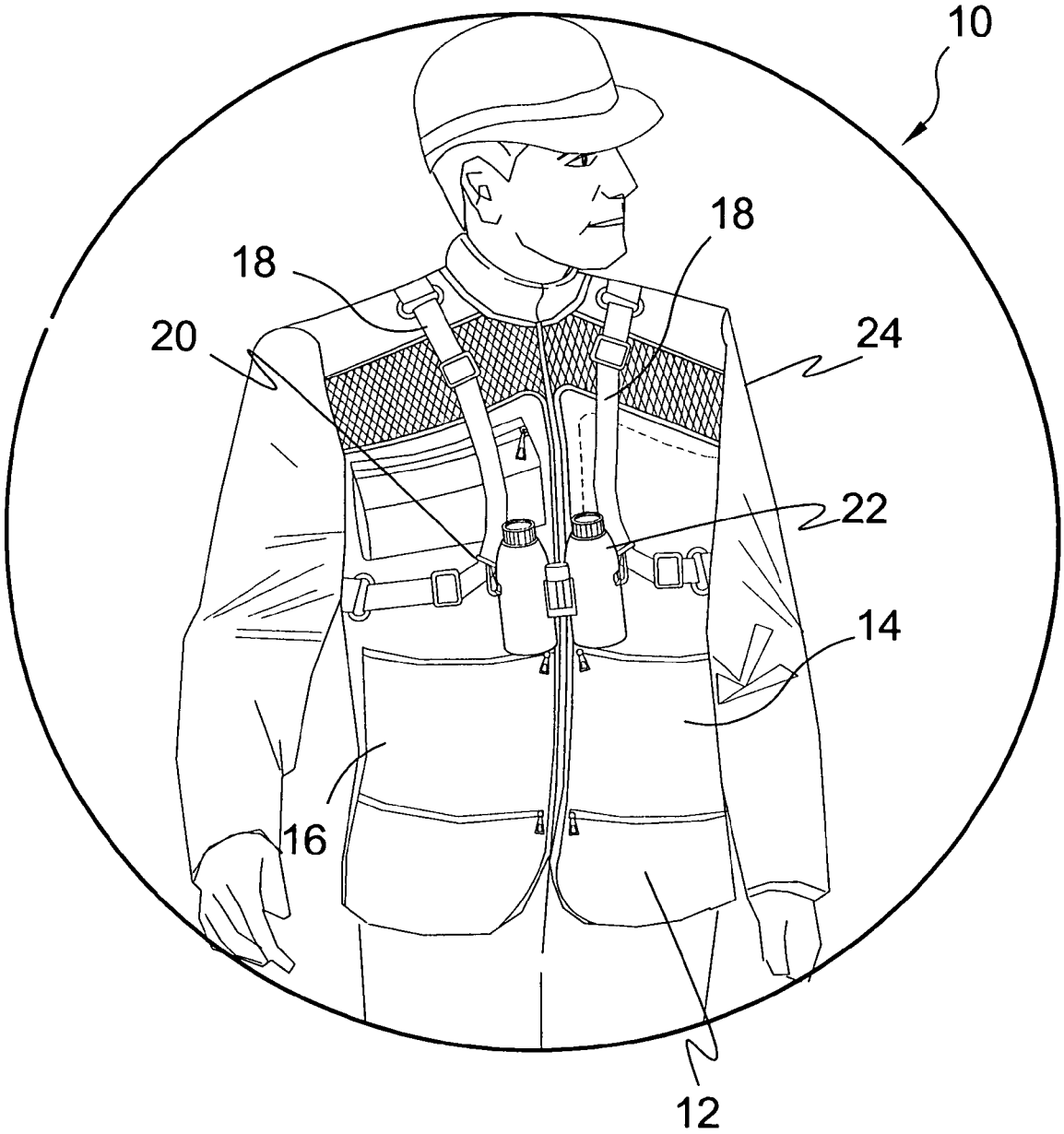
FIG. 1 is an illustrative view of the present invention in use.

Turning now descriptively to the drawings, in which similar reference characters denote similar elements throughout the several views, the figures illustrate the Garment Attachable Elastomeric Lanyard of the present invention. With regard to the reference numerals used, the following numbering is used throughout the various drawing figures.

10 Garment Attachable Elastomeric Lanyard of the present invention
12 garment
13 back panel of 12
14 left panel of 12
16 right panel of 12
18 elastic strap assembly
20 slidable fastener
22 binoculars
24 user
26 anchor strap
28 ring fastener
30 elastic strap
32 friction buckle
34 pivot clip
36 garment seam
38 stitches
40 tongue and buckle fastener element
42 eyelets of 22
44 tensioning fastener
46 connector element
48 female end of 46
50 male end of 46
52 backpack
54 strap of 52

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a garment 12 for the upper torso for retaining an optical device such as binoculars 22 having a back side and left 14 and right 16 front panels with each panel having an elastic strap assembly 18 extending from the shoulder to its respective side with a slidable fastener 20 traveling therebetween. The present invention 10 allows the user 24 to have the binoculars 22 secured in a hand free manner in a location that will permit him to use them quickly with the cumbersome chore of releasing the optical device from the securing device.

Figure 2:
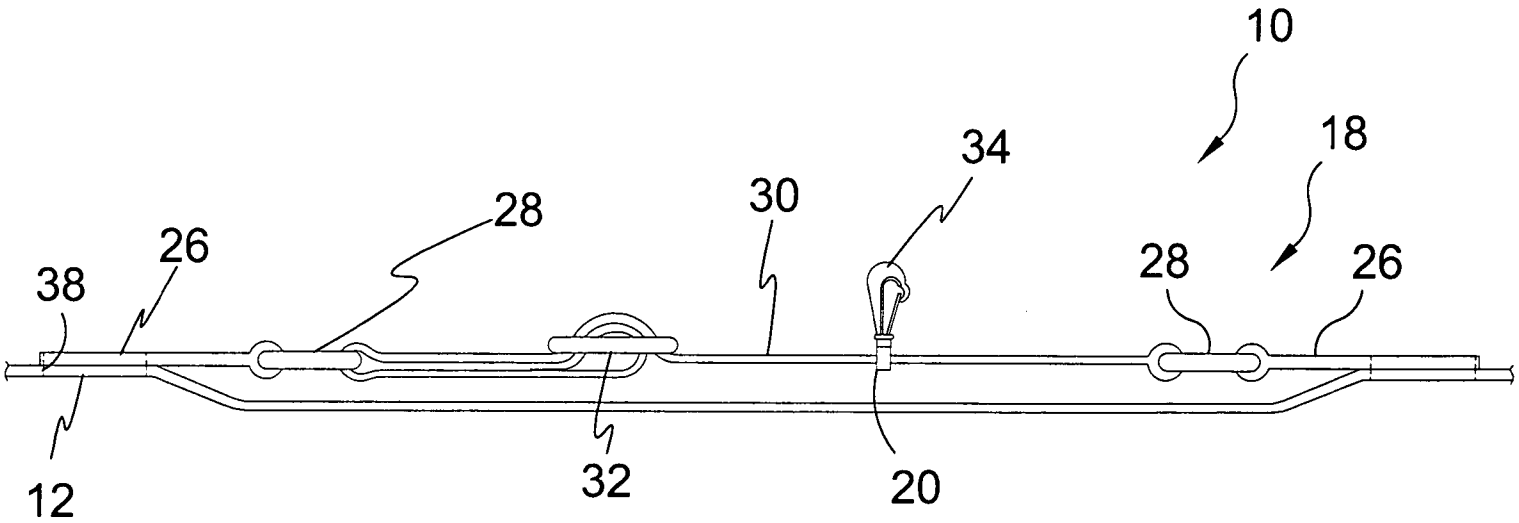
FIG. 2 is a side view of the present invention.

FIG. 2 is a side view of the elastic strap assembly 18 of the present invention 10. Shown is the strap assembly 18 having an anchor strap 26 on each end stitched 38 into the garment 12. Ring fasteners 28 are secured to the distal ends of the anchor straps 26 and one end of the elastic strap 30 is permanently secured to its respective ring fastener 28 and passes under an outer post of a friction buckle 32 and over a center post and back under the opposing outer post and is looped around the other ring fastener 28 before returning to the friction buckle 32 where the end is secured to the center post thereof. A pivot clip 34 is disposed on the slidable fastener 20 on the elastic strap 30.

Figure 3:
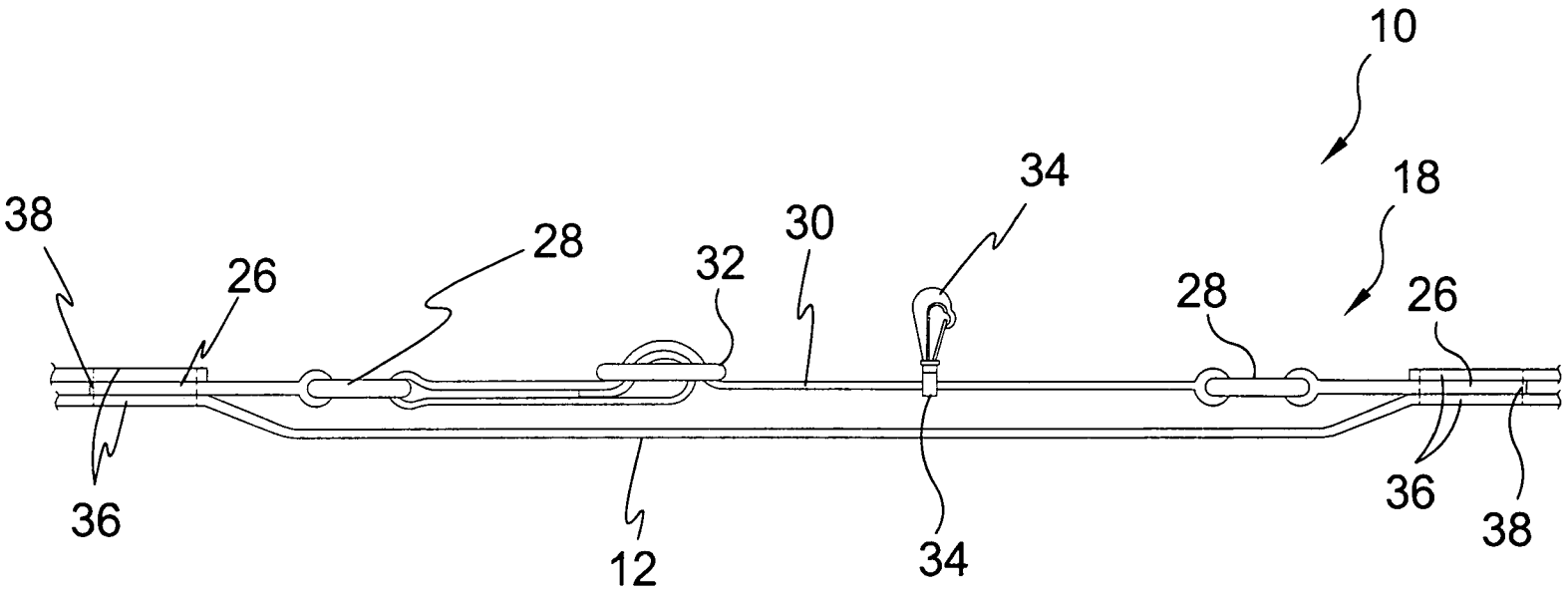
FIG. 3 is a side view of the present invention.

FIG. 3 is a side view of the elastic strap assembly 18 of the present invention 10. Shown is the strap assembly 18 having an anchor strap 26 on each end stitched 38 into the seams 36 of the garment 12. Ring fasteners 28 are secured to the distal ends of the anchor straps 26 and one end of the elastic strap 30 is permanently secured to its respective ring fastener 28 and passes under an outer post of a friction buckle 32 and over a center post and back under the opposing outer post and is looped around the other ring fastener 28 before returning to the friction buckle 32 where the end is permanently secured to the center post thereof. A pivot clip 34 is disposed on the slidable fastener 20 on the elastic strap 30.

Figure 4:
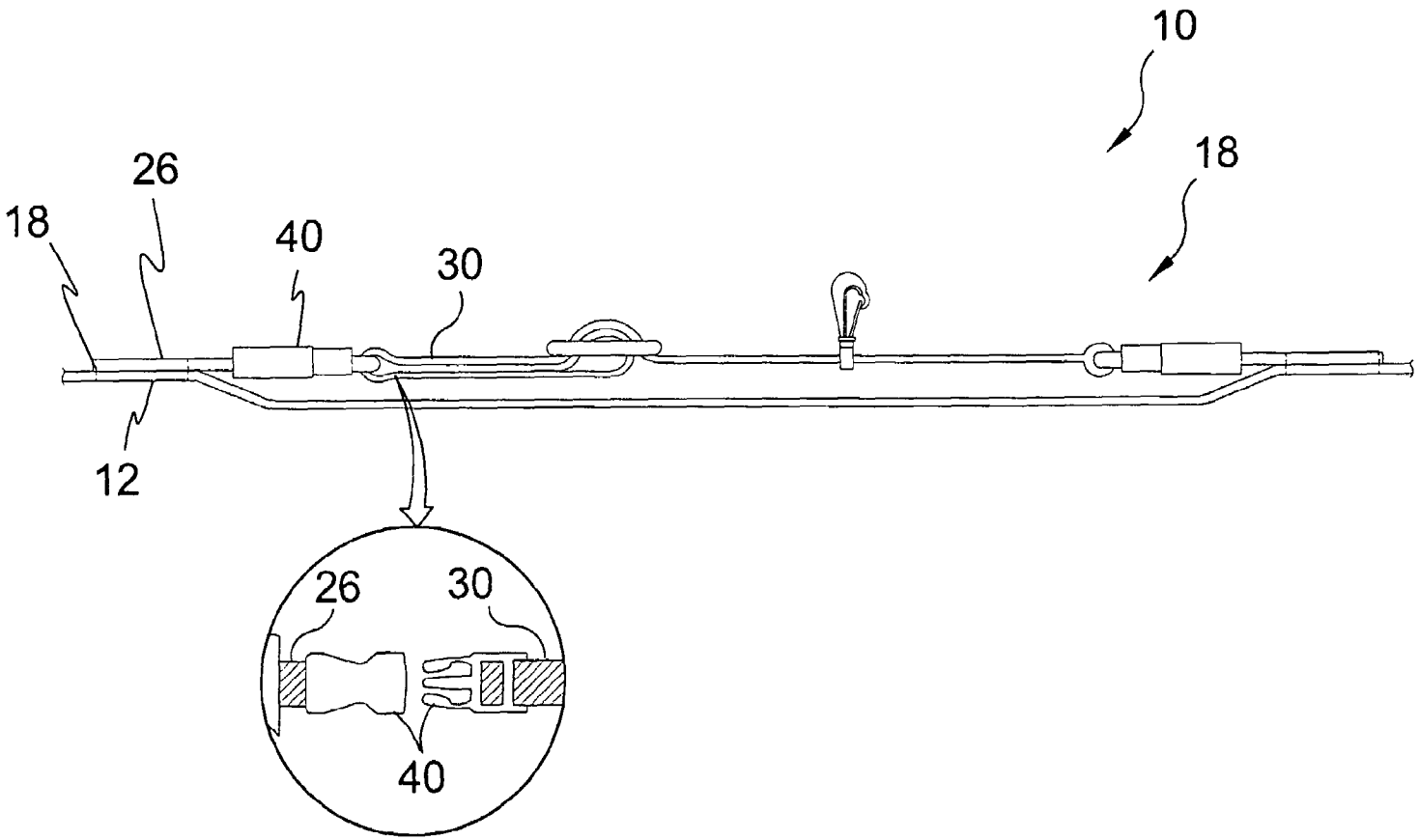
FIG. 4 is a side view of the present invention.

FIG. 4 is a side view of the present invention 10 having a removable elastic strip assembly 18 that is selectively removable from the garment 12. A tongue and buckle fastener element 40 is utilized to removably attach the elastic strap 30 to the anchor straps 26.

Figure 5:
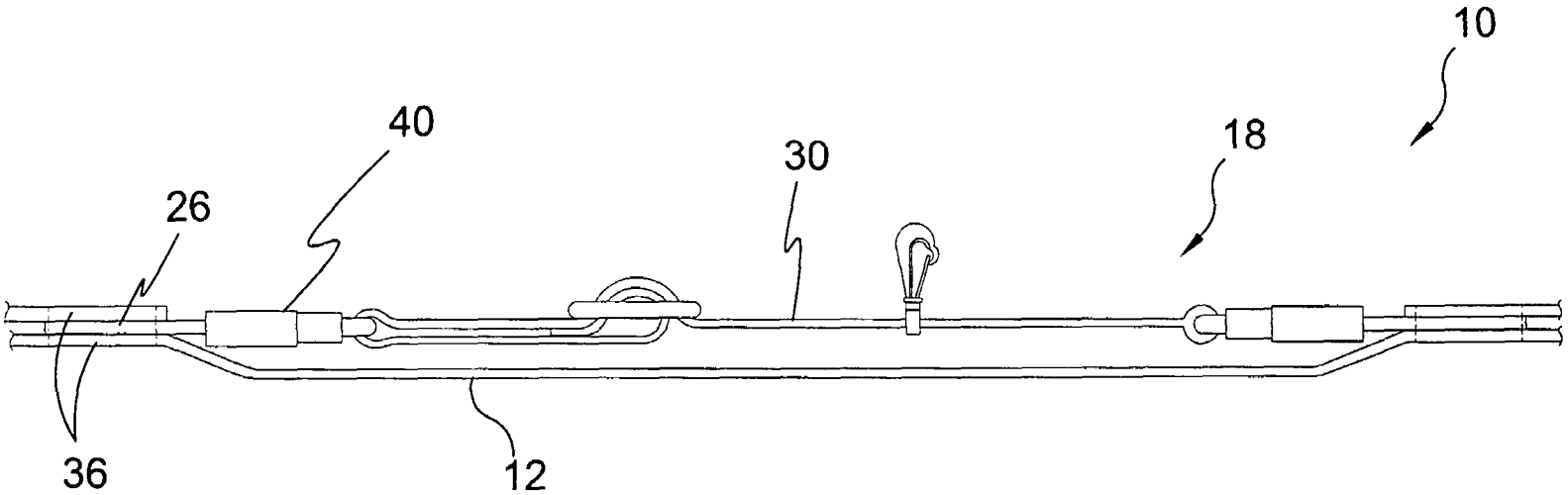
FIG. 5 is a side view of the present invention.

FIG. 5 is a side view of the present invention 10 having a removable elastic strip assembly 18 that is selectively removable from the garment 12. A tongue and buckle fastener element 40 is utilized to removably attach the elastic strap 30 to the anchor straps 26 which are stitched 38 into the seams 36 of the garment 12.

Figure 6:
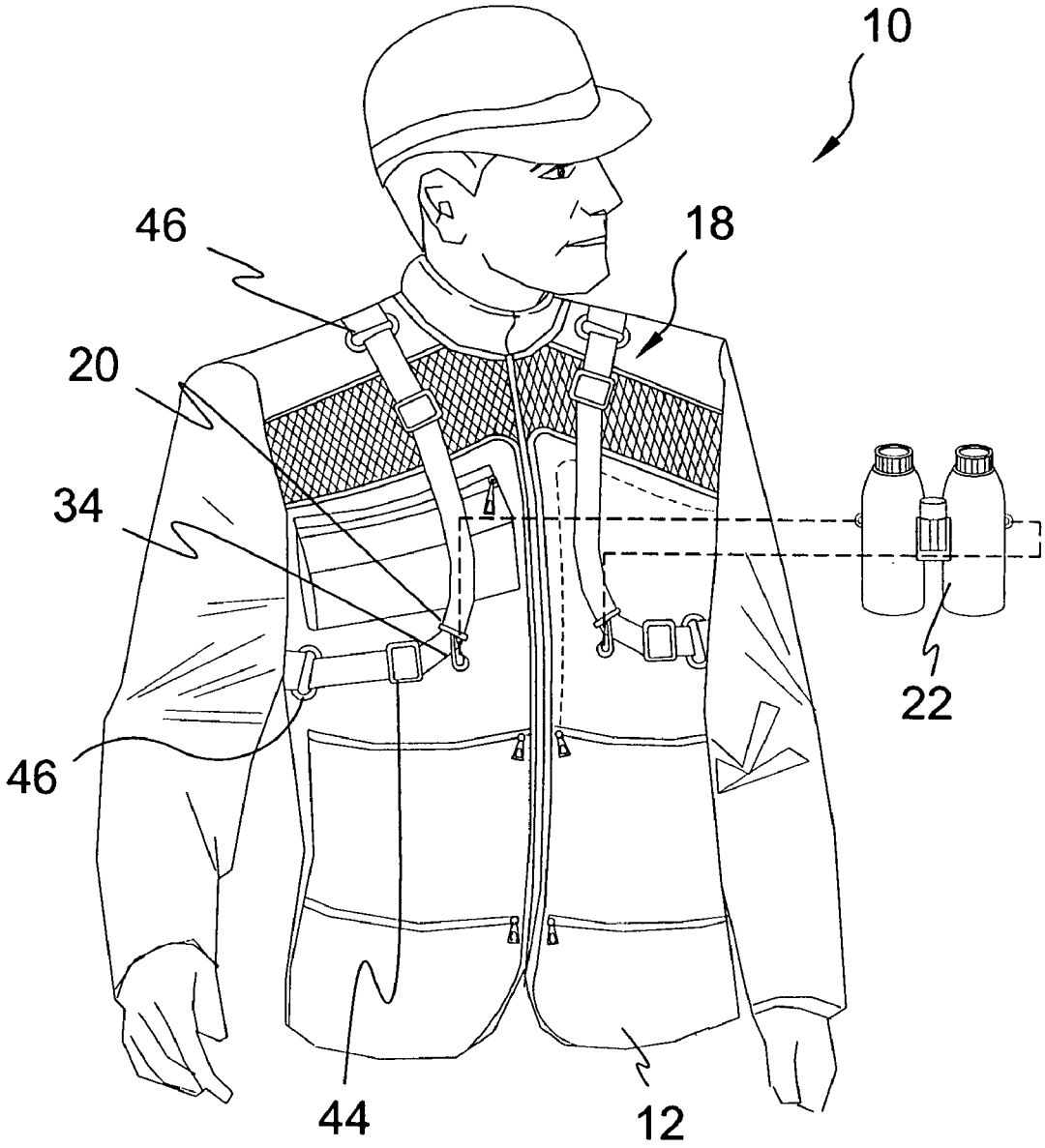
FIG. 6 is an illustrative view of the present invention without binoculars attached.

FIG. 6 is an illustrative view of the present invention 10 without binoculars 22 attached. Shown is the present invention 10, a garment 12 for the attachment of binoculars 22 having elastic strap connectors 46 located on both shoulder and sides of said garment 18. The straps 30 can be permanently attached or releasably removed. The strap assembly 18 comprises a slidable fastener 20, clip member 34 and a tensioning fastener 44.

Figure 7:
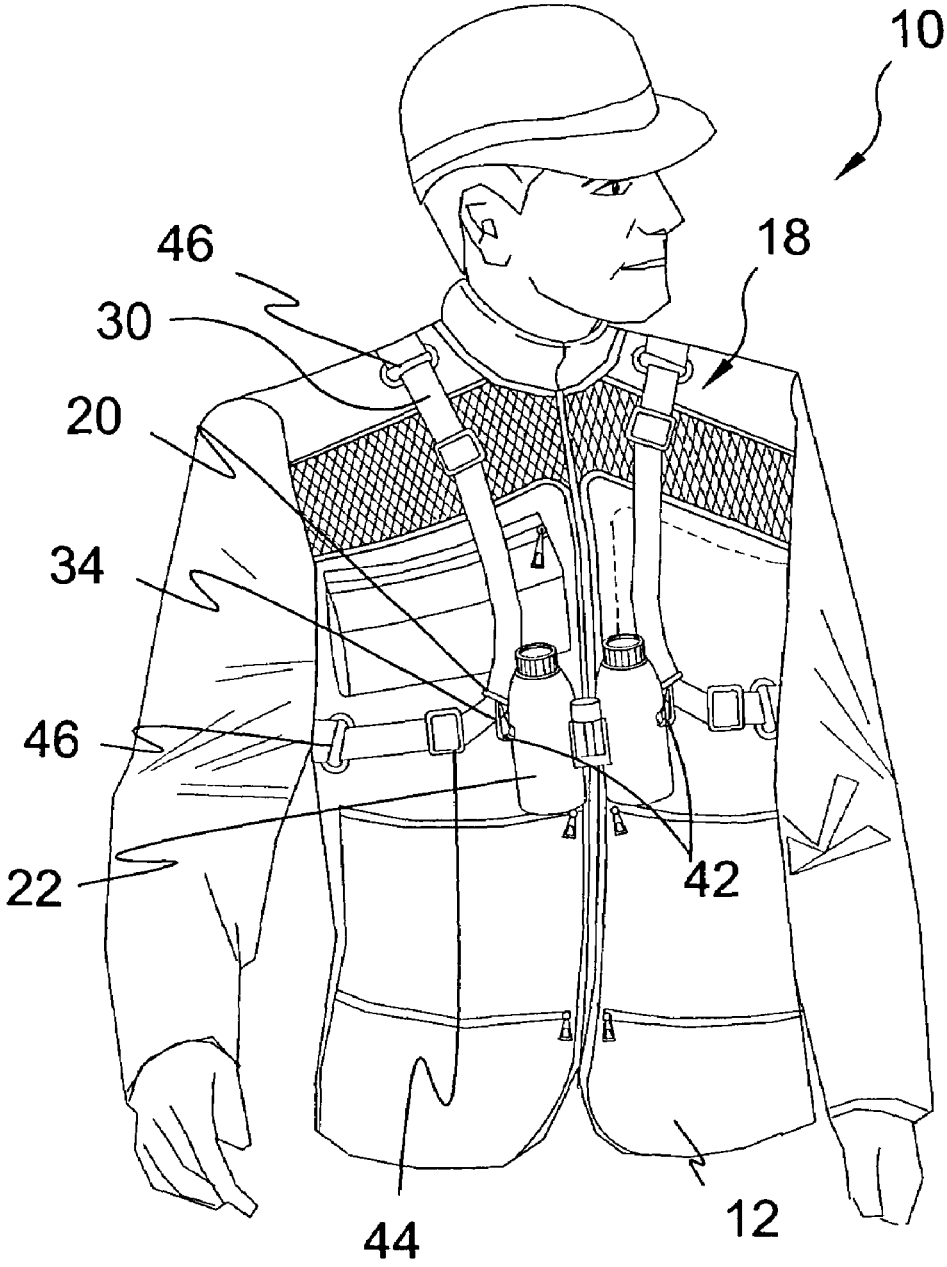
FIG. 7 is an illustrative view of the present invention with binoculars attached.

FIG. 7 is an illustrative view of the present invention 10 with the binoculars 22 having eyelets 42 attached to the clips 34. Shown is the present invention 10, a garment 12 for the attachment of binoculars 22 having elastic strap connectors 46 located on both shoulder and sides of said garment 18. The straps 30 can be permanently attached or releasably removed. The strap assembly 18 comprises a slidable fastener 20, clip member 34 and a tensioning fastener 44.

Figure 8:
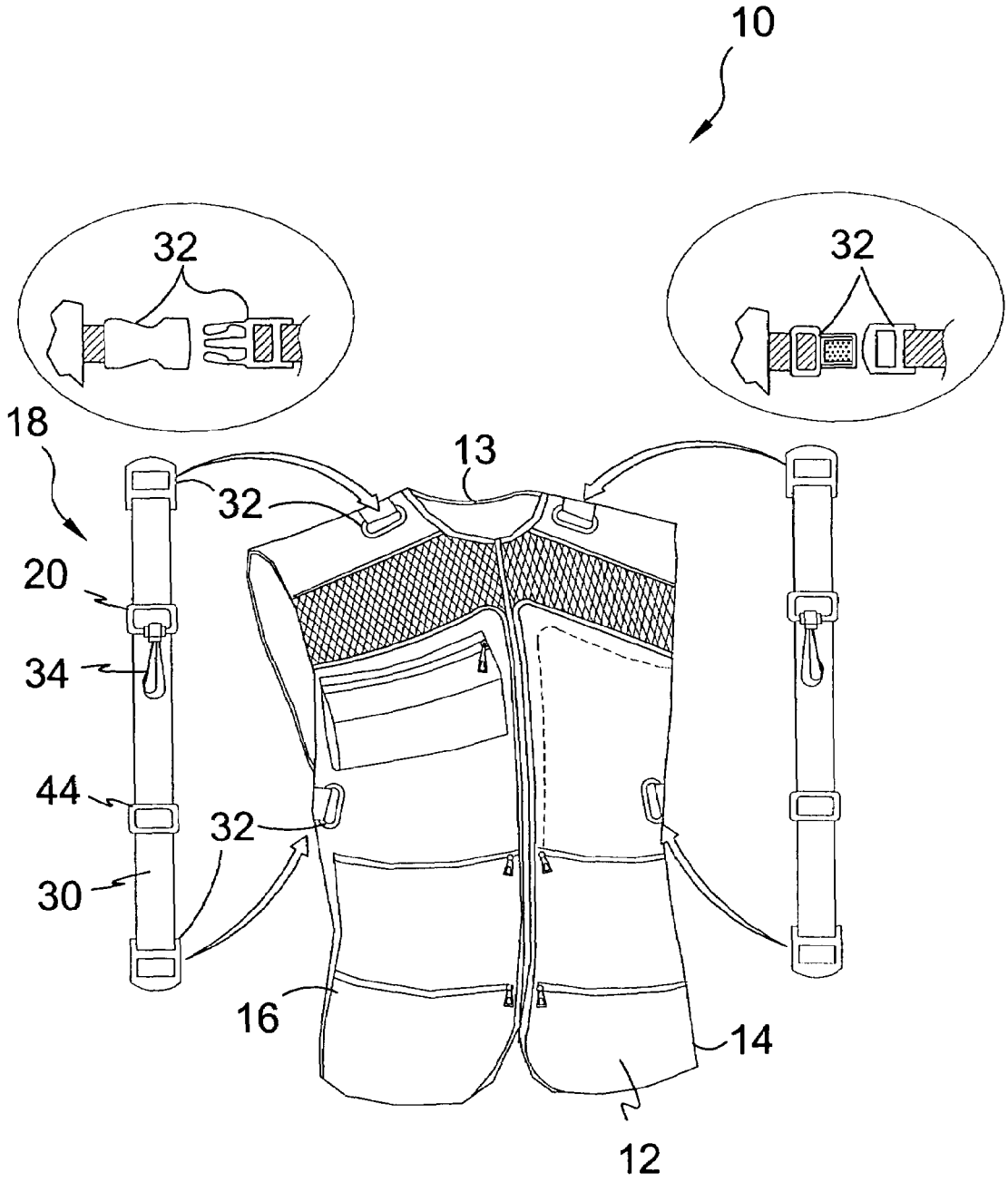
FIG. 8 is an illustrative view of the present invention.

FIG. 8 is an illustrative view of the present invention 10. Shown is the present invention 10, a garment 12 for the upper torso having a back 13, left 14 and right 16 front panels with each panel having a detachable elastic strap assembly 18 extending from the shoulder to its respective side with a slidable fastener 20, tensioning fastener 44, and clip 34 traveling on a strap 30 therebetween. Said elastic strap assembly 18 fixedly positioned at its point of attachment and alternately each point of attachment comprising a releasable buckle 32.

Figure 9:
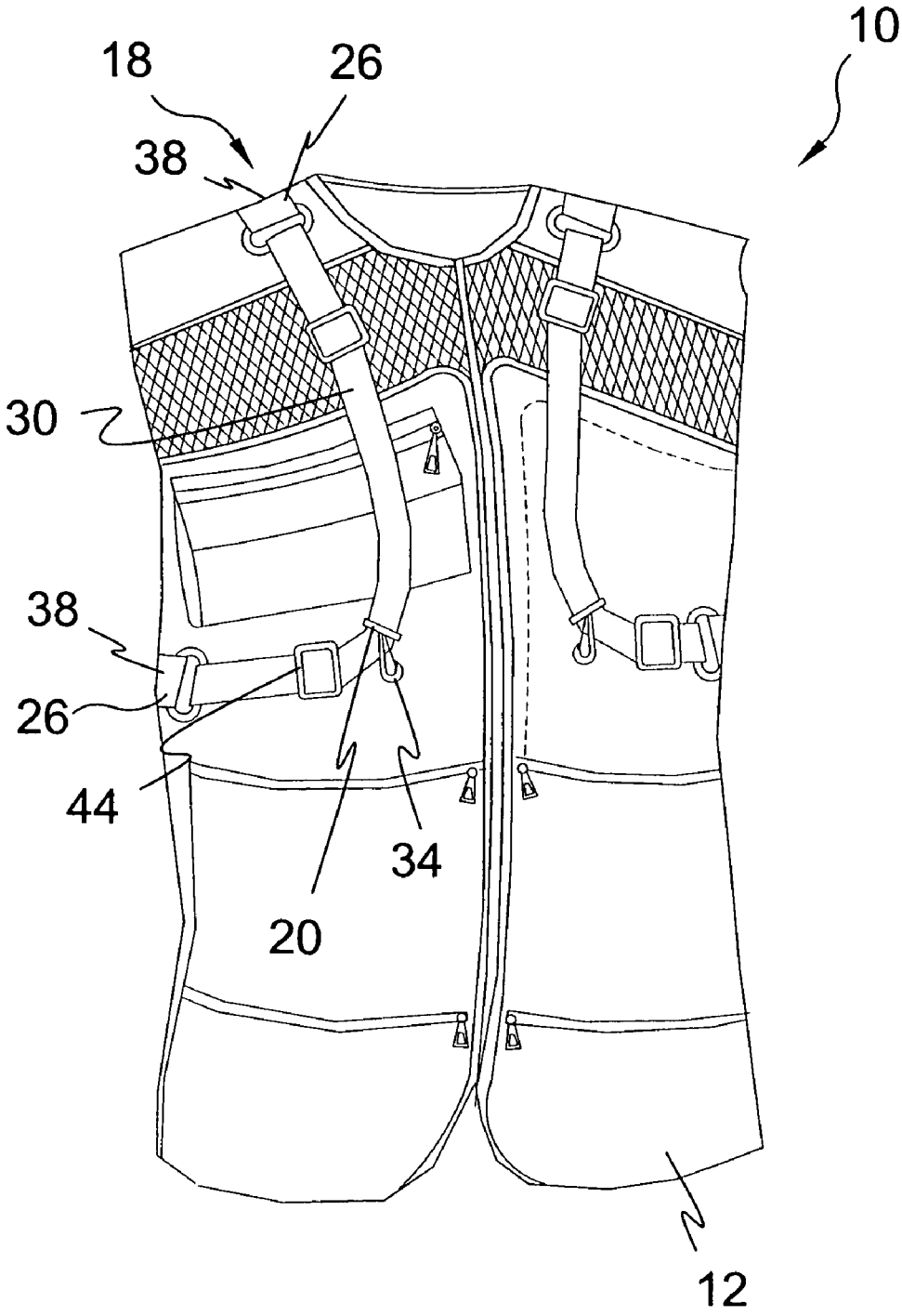
FIG. 9 is a front view of the present invention having straps attached.

FIG. 9 is a front view of the present invention having the strap assemblies 18 permanently attached. Shown is the present invention 10, a garment 12 having a permanent elastic strap assembly 18 extending from the shoulder to its respective side with a slidable fastener 20, tensioning fastener 44, and clip 34 traveling on a strap 30 therebetween. Said elastic strap assembly 18 fixedly positioned at its point of attachment and alternately each point of attachment with the anchor straps 26 stitched 38 into the seams of the garment 12.

Figure 10:
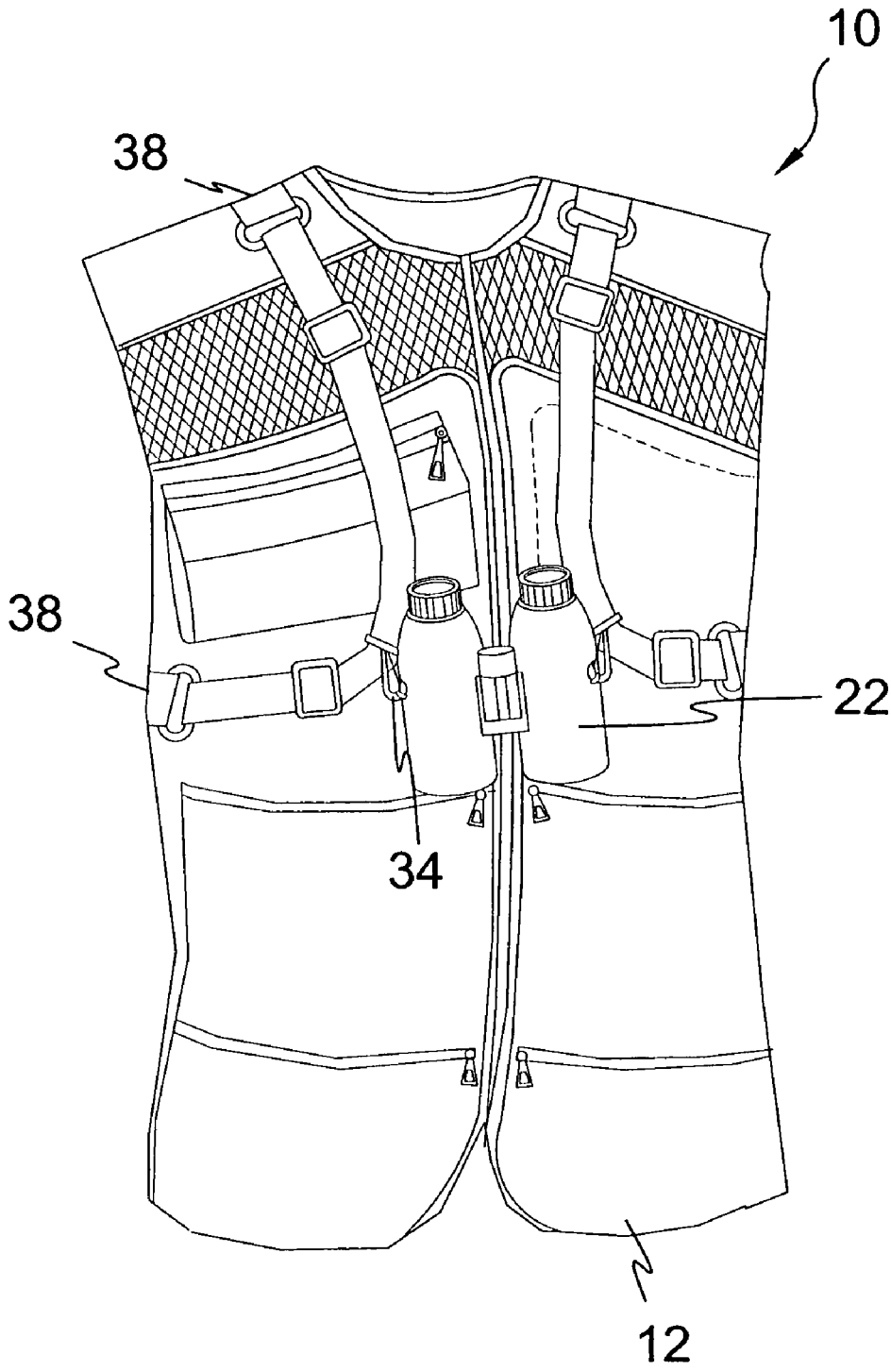
FIG. 10 is a front view of the present invention with binoculars attached.

FIG. 10 is a front view of the present invention 10 with binoculars 22 attached to the clips 34 thereof. The present invention 10 is a garment 12 having elastic strap assemblies 18 permanently stitched 38 on both shoulder and sides of said garment 12.

Figure 11:
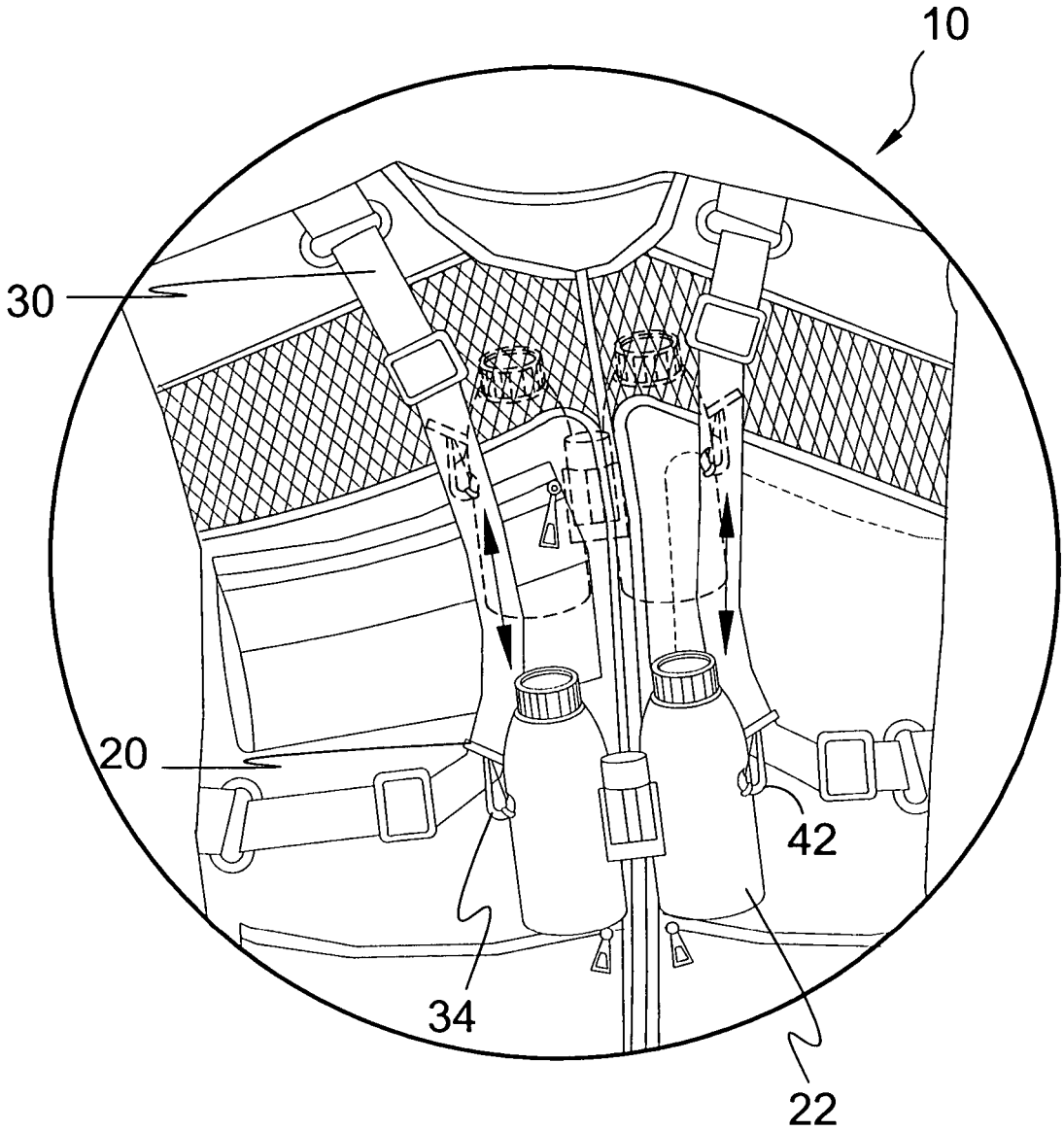
FIG. 11 is a detailed view of the present invention.

FIG. 11 is a detailed view of the present invention 10 with the binoculars 22 attached to the clips 34 on the slidable fasteners 20. The illustration demonstrates how the binoculars 22 may be selectively positioned along the elastic strap 30 by adjusting the slidable fasteners 20 accordingly.

Figure 12:
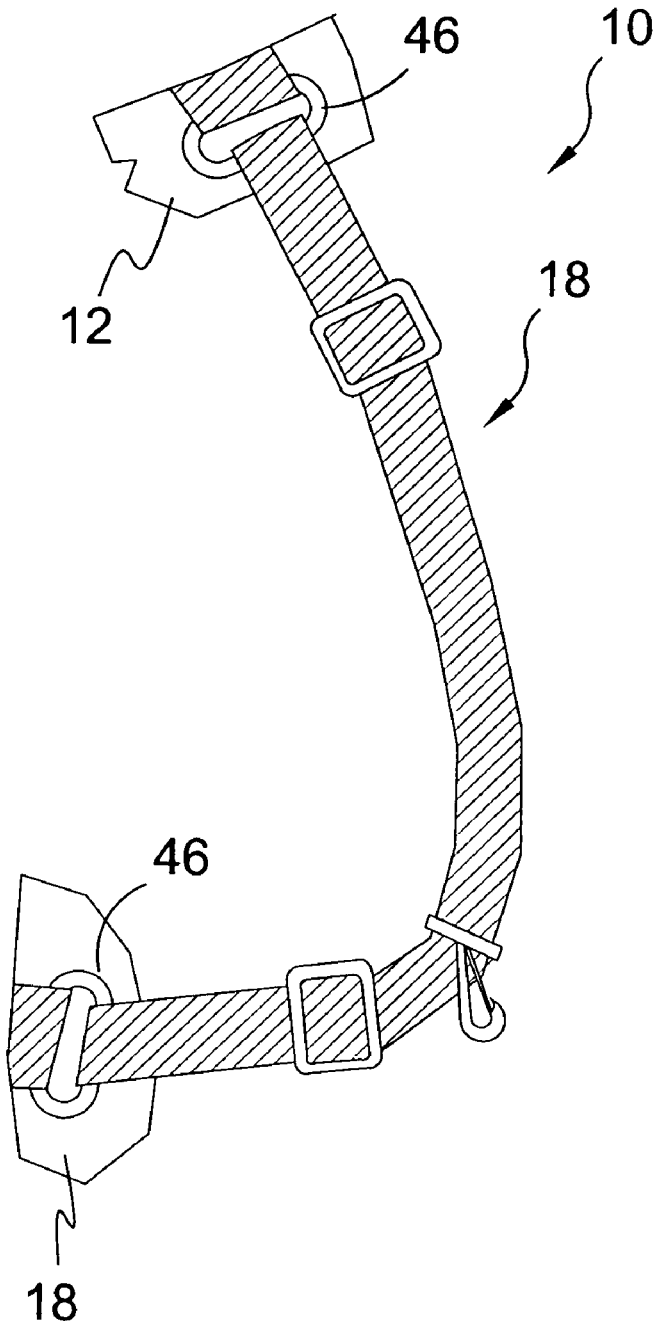
FIG. 12 is a detailed view of the permanently attached strap of the present invention.

FIG. 12 is a detailed view of the permanently attached strap assembly 18 of the present invention 10 wherein the connector 46 is integral with the garment 12.

Figure 13:
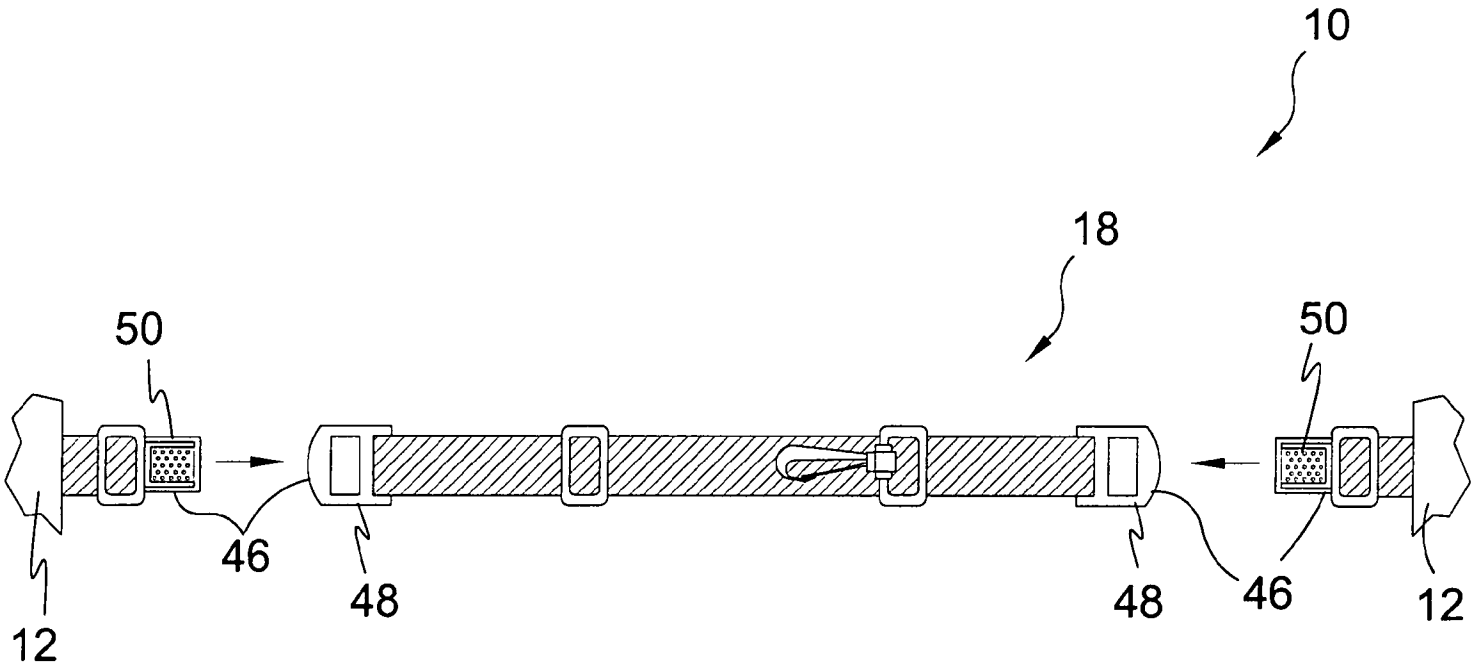
FIG. 13 is a top view of a releasable strap of the present invention.

FIG. 13 is a top view of a releasable strap assembly 18 of the present invention 10. Shown is the strap assembly 18 using a detachable connector 46 having female ends 48 on the ends of the strap assembly 18 and male ends 50 integral with the garment 12 demonstrating how any suitable connector 46 element or configuration may be employed.

Figure 14:
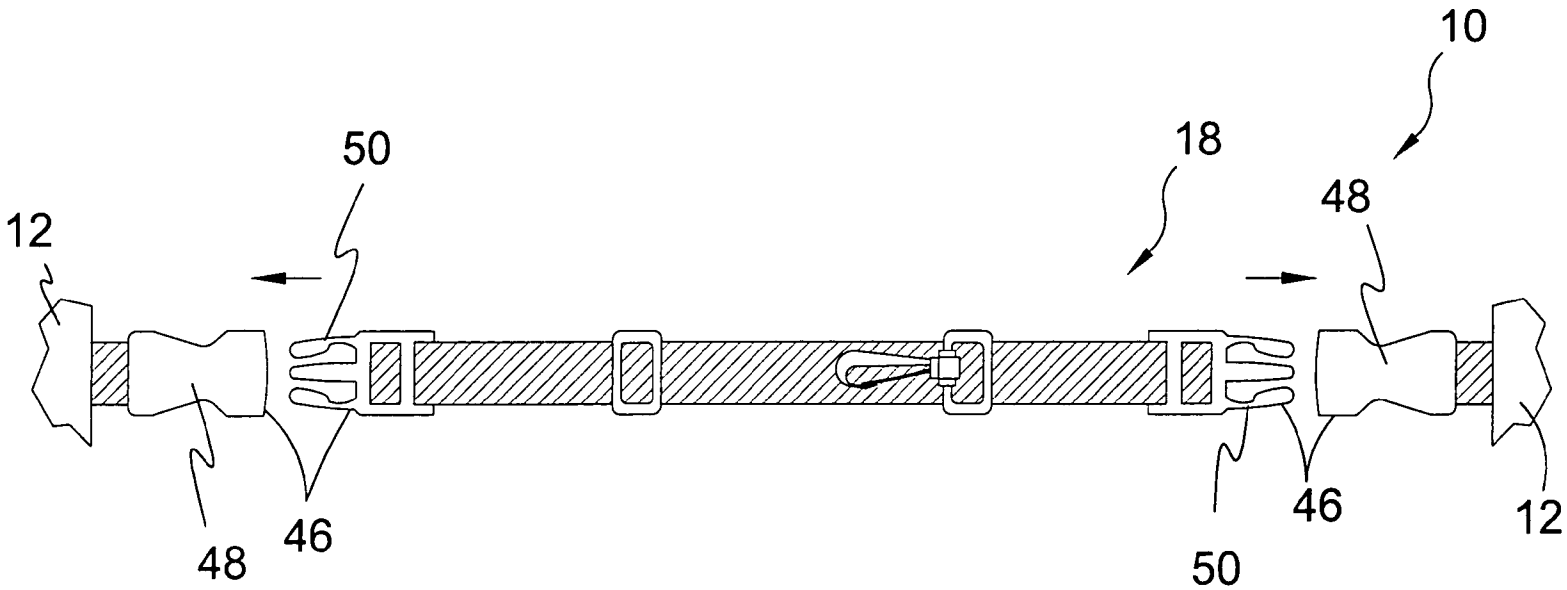
FIG. 14 is a top view of another type of releasable strap connectors of the present invention.

FIG. 14 is a top view of another type of releasable strap connectors 46 of the present invention 10. Shown is the strap assembly 18 using a detachable connector 46 having male ends 50 on the ends of the strap assembly 18 and female ends 48 integral with the garment 12 demonstrating how any suitable connector 46 element or configuration may be employed.

Figure 15:
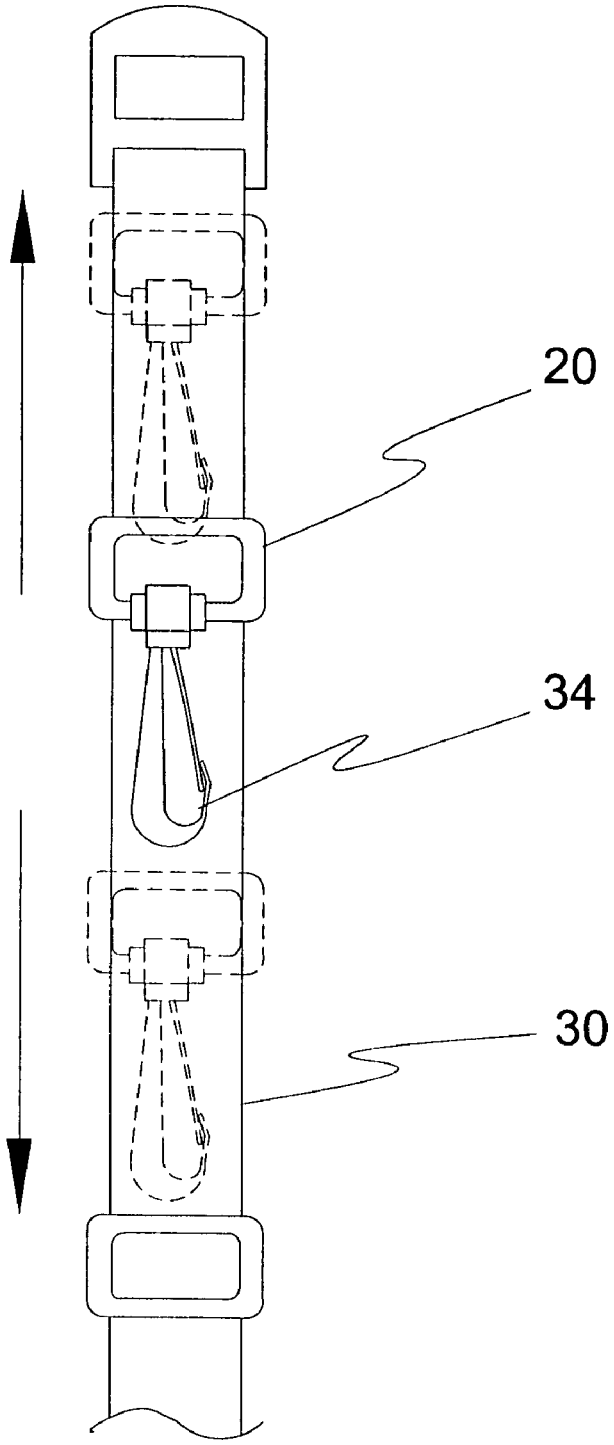
FIG. 15 is a detailed view of the sliding clip of the present invention.

FIG. 15 is a detailed view demonstrating how the slidable fastener 20 and its associated clip 34 can be selectively repositioned along the elastic strap 30.

Figure 16:
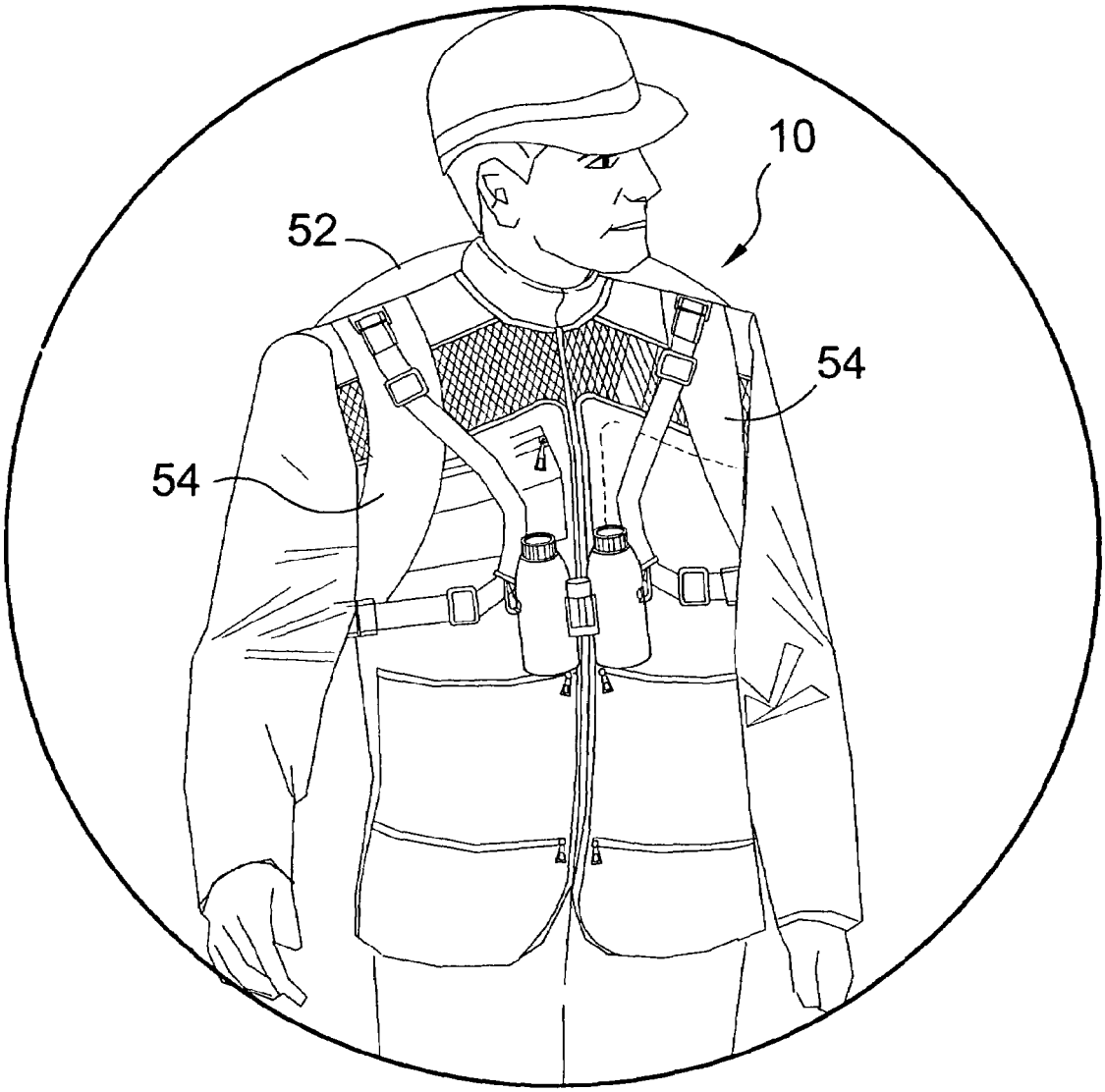
FIG. 16 is an illustrative view of the present invention having an additional element.

FIG. 16 is an illustrative view of the present invention 10 having an additional element in use. Shown is the present invention 10 combined with a backpack 52 and its associated straps 54 whereby connection elements may be interwoven or integrated with the said backpack 52 to provide attachment specifically to the backpacks straps 54 or body 52 via a provided living connection or straps with associated connectors.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is:

1. A garment attachable elastomeric lanyard for retaining an optical device comprising:

a) a pair of opposing strap assemblies, wherein each said strap assembly comprises:

i) an elastomeric strap having a first end and a second end;

ii) a clip for attaching to and securing an optical device; and iii) means for securing said clip to said elastomeric strap in a manner allowing for the selective positioning thereof along said strap;

iv) a friction buckle tensioning fastener for adjusting the length and tension of said strap; and b) means for securing the ends of said strap assemblies to an object to be worn by the user;

c) wherein, said clip securing means is a slidable fastener;

d) wherein said strap assembly securing means is permanent; and e) wherein said permanent strap assembly securing means comprises a first anchor strap that is stitched to said object and has a ring fastener secured thereto in which said strap is looped around and said first end is permanently secured to said friction buckle and a second anchor strap that is stitched to said object and has a ring fastener secured thereto to which said second end of said strap is permanently secured thereto.

2. A garment attachable elastomeric lanyard for retaining an optical device as recited in claim 1, wherein said anchor straps are stitched into the seams of said object.

3. A garment attachable elastomeric lanyard for retaining an optical device as recited in claim 1, wherein said object is a garment.

4. A garment attachable elastomeric lanyard for retaining an optical device as recited in claim 1, wherein said object is a backpack.

5. A garment attachable elastomeric lanyard for retaining an optical device comprising:

a) a pair of opposing strap assemblies, wherein each said strap assembly comprises:

i) an elastomeric strap having a first end and a second end;

ii) a clip for attaching to and securing an optical device; and iii) means for securing said clip to said elastomeric strap in a manner allowing for the selective positioning thereof alone said strap;

iv) a friction buckle tensioning fastener for adjusting the length and tension of said strap; and b) means for securing the ends of said strap assemblies to an object to be worn by the user;

c) wherein, said clip securing means is a slidable fastener;

d) wherein said strap assembly securing means is releasable;

e) wherein said releasable strap assembly securing means includes buckle members disposed on the ends of said strap assembly and mating buckle members secured to anchor straps stitched to said object.

6. A garment attachable elastomeric lanyard for retaining an optical device as recited in claim 5, wherein said anchor straps are stitched into the seams of said object.

* * * * *